US009579658B2

(12) United States Patent
Zhou et al.

(10) Patent No.: US 9,579,658 B2
(45) Date of Patent: Feb. 28, 2017

(54) METHOD AND SYSTEM FOR MAGNETIC ACTUATED MIXING

(71) Applicant: XEROX CORPORATION, Norwalk, CT (US)

(72) Inventors: Ke Zhou, Oakville (CA); Shiying Lu, Toronto (CA); Jun Zhao, Mississauga (CA); Sandra J. Gardner, Oakville (CA); Yulin Wang, Oakville (CA); John Abate, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 530 days.

(21) Appl. No.: 14/203,274

(22) Filed: Mar. 10, 2014

(65) Prior Publication Data

US 2015/0251186 A1 Sep. 10, 2015

(51) Int. Cl.
*B02C 17/00* (2006.01)
*B02C 17/20* (2006.01)

(52) U.S. Cl.
CPC ..... *B02C 17/005* (2013.01); *B02C 17/20* (2013.01)

(58) Field of Classification Search
CPC ..... B02C 17/005; B02C 17/20
USPC ..... 241/184, 170–172
See application file for complete search history.

(56) References Cited

U.S. PATENT DOCUMENTS 529,766 A * 11/1894 Wheeler ..... B02C 17/161 241/105
4,601,431 A * 7/1986 Watanabe ..... B02C 17/005 241/172
4,676,439 A * 6/1987 Saito ..... B02C 17/005 241/172
5,183,214 A * 2/1993 Zakheim ..... B02C 17/163 241/172
5,383,615 A * 1/1995 Calka ..... B02C 17/005 241/172
6,719,610 B2 * 4/2004 Chou ..... B02C 17/005 241/171

OTHER PUBLICATIONS

Jain, V.K., Sidpara, A., Sankar, M.R. and Das, M., Proceedings of the Institution of Mechanical Engineers, Part C: Journal of Mechanical Engineering Science, Oct. 26, 2011; pp. 326-346.
Shorey, Aric Bruce, Mechanisms of Material Removal in Magnetorheological Finishing (MRF) of Glass, 2000; pp. 88-100.

* cited by examiner

*Primary Examiner* — Faye Francis
(74) *Attorney, Agent, or Firm* — Pillsbury Winthrop Shaw Pittman LLP

(57) ABSTRACT

A method and system for magnetic actuated mixing which use magnetic particles, non-magnetic abrasive particles and electromagnetic field to facilitate milling. The method and system use magnetic particles and a generated electromagnetic field to facilitate the milling as well. The method and system can be used in any application that requires the preparation of small-sized particles at either the micro or nano scale, including for example, preparing toners, inks, wax, pigment dispersions and the like.

20 Claims, 5 Drawing Sheets

METHOD AND SYSTEM FOR MAGNETIC ACTUATED MIXING

BACKGROUND

The presently disclosed embodiments relate generally to a method and system for magnetic actuated mixing which use magnetic particles and electromagnetic field to facilitate milling of different materials. In the present embodiments, the mixing of materials uses the step of milling. Milling is the process of breaking down material and thus involves particle size reduction. The magnetic particles act as milling media. The system further includes non-magnetic abrasive particles in the milling media to facilitate the milling. The present embodiments may be used in many different applications, including for example, preparing toners, inks, wax, pigment dispersions, paints, photoreceptor materials and the like. The present embodiments may be used for any application that requires the preparation of small-sized particles at either the micro or nano scale.

In many batch processes, the milling step is one of most critical steps to determine the overall performance of the process. For example, in applications where small-sized particles are produced, achieving the small scale and uniform distribution of the particles is determined by the milling step.

Improvements on milling methods and systems often generate more complex setups which have their own set of problems, such as increase mechanical maintenance of parts. Recently, acoustic mixing has been used to avoid inefficient milling. As shown in FIG. 1, an acoustic mixing system 30 uses a non-contact mean to provide micro scale mixing 35 within a micro zone of about 50 μm in a closed vessel 40. However, generating the acoustic wave still relies on mechanical resonance as controlled by engineered plates, eccentric weights and springs. Special care and protection of the mechanism to generate mechanical resonance is typically used and any small turbulence may cause catastrophic damage on the system. Therefore, the overall service life is still limited to the effective lifetime of the mechanical components. Thus, such systems are not free of mechanical maintenance. In addition, the acoustic energy decays at distances far away from the source.

There is thus a need for a new and improved milling method and system that overcomes the problems encountered with the conventional systems being used as described above.

SUMMARY

In embodiments, there is provided a method for mixing one or more materials on a nano or micro scale, comprising: a) adding one or more materials into a vessel; b) adding magnetic particles into the vessel; c) adding non-magnetic abrasive particles into the vessel; d) applying a varying magnetic field to the magnetic particles to move the magnetic particles; e) milling the one or more materials in the vessel with the magnetic and non-magnetic abrasive particles until a desired particle size is achieved; f) collecting the magnetic particles for re-using at a later time; and g) collecting the non-magnetic abrasive particles for re-using at a later time.

Another embodiment provides a method for mixing one or more materials on a nano or micro scale, comprising: a) pre-loading magnetic particles and non-magnetic abrasive particles into a vessel; b) adding one or more materials into the vessel; c) applying a varying magnetic field to the magnetic particles to move the magnetic particles; d) milling the one or more materials in the vessel with the magnetic and non-magnetic abrasive particles until a desired particle size is achieved; e) collecting the magnetic particles for re-using at a later time; and f) collecting the non-magnetic abrasive particles for re-using at a later time.

In yet another embodiment, there is provided a system for mixing one or more materials on a nano or micro scale, comprising: a) a vessel for holding one or more materials; b) magnetic particles for milling the one or more materials; c) non-magnetic abrasive particles for milling the one or more materials; d) a source for applying a periodically varying magnetic field to the magnetic particles to move the magnetic particles; e) a first collector for collecting the magnetic particles for re-using at a later time; and f) a second collector for collecting the non-magnetic abrasive particles for re-using at a later time.

BRIEF DESCRIPTION OF THE DRAWINGS

For a better understanding of the present embodiments, reference may be made to the accompanying figures.

DETAILED DESCRIPTION

Figure 1:
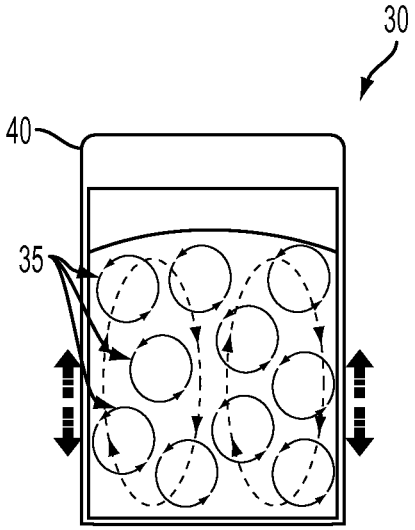
FIG. 1 PRIOR ART
FIG. 1 is a diagram of a conventional acoustic mixing system.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

As briefly mentioned, the presently disclosed embodiments relate generally to a method and system for magnetic actuated milling which use magnetic particles and non-magnetic abrasive particles as a milling media. An electromagnetic field applied to the milling media facilitates the milling. It has been discovered that use of magnetic particles and electromagnetic field as a method of actuated milling achieves much better results more efficiently. For example, the resulting particle sizes of the dispersion subjected to the milling are consistently on the desired micro-nano scale. Moreover, the present embodiments require much less system component parts and process steps to achieve the results as compared to conventional systems and processes.

It was further discovered that the addition of non-magnetic abrasive particles to the milling media provided even better actuated milling. The non-magnetic abrasive particles, like those used as polishing abrasives in the magnetorheological finishing industry, are hard micron-sized materials responsible for material size reduction (for example, see Nanoindentation Hardness of Particles Used in Magnetorheological Finishing (MRF) Aric B. Shorey, Kevin M. Kwong, Kerry M. Johnson, and Stephen D. Jacobs Applied Optics, Volume 39, Issue 28 (2000)). These abrasive particles have hardness values that exceed those of magnetic particles. When used in conjunction with the magnetic particles, the non-magnetic abrasive particles provide even more effective results in solid particle size reduction, especially in grinding certain pigment particles. The collision between the magnetic particles and non-magnetic abrasive particles amplify the shearing forces of the magnetic particles alone to not only achieve the desired small scale and uniform distribution of the mixed particles, but to do so quickly. The non-magnetic particles may be later removed by any method including filtering, screening, centrifuging, and the like. While the use of the non-magnetic abrasive particles does add to the system components and process steps, the smaller particle sizes achieved outweigh any drawbacks.

Figure 2:
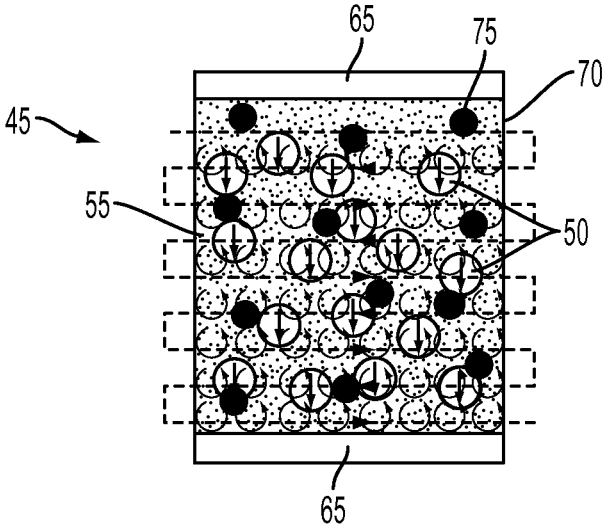
FIG. 2 is a diagram of a magnetic actuated mixing system in accordance with the present embodiments.

The present embodiments provide a method and system for magnetic actuated milling which use magnetic particles and electromagnetic field to facilitate the milling. In embodiments, the method and system is used for improved milling in batch processes. As shown in FIG. 2, there is provided a mixing system 45 comprising magnetic particles 50 and non-magnetic abrasive particles 75 loaded in a solution 55 which is moved to actuate milling by the periodic variation of a magnetic field 60 applied to the magnetic particles 50. The magnetic particles may be preloaded or filled into the milling vessel 70 when milling is needed. The magnetic field 60 is applied through electromagnets 65 on either side of the milling vessel 70. The mixing system 45 achieves intense micro mixing zone 75 uniformly throughout the mixing vessel 70. The magnetic particles can be successfully collected and recycled by electromagnets for subsequent applications. The non-magnetic particles may be removed by any method including filtering, centrifuging, and the like The magnetic particles may be comprised of diamagnetic, paramagnetic, ferrimagnetic, ferromagnetic or antiferromagnetic materials such that the overall magnetic particle is paramagnetic, ferrimagnetic, ferromagnetic or antiferromagnetic. In some exemplary embodiments, the magnetic particles may comprise Fe, $Fe_2O_3$, Ni, $CrO_2$, or Cs. In specific embodiments, the magnetic particles include carbonyl iron and carbonyl nickel. In embodiments, the magnetic particles may have a non-magnetic coating. In other embodiments, the magnetic particles can also be encapsulated with a shell, for example, a polymeric shell comprising, in embodiments, polystyrene, polyvinyl chloride, TEFLON®, PMMA, and the like and mixtures thereof. The magnetic particles may have a diameter of from about 5 nm to about 50 μm, or from about 10 nm to about 10 μm, or from about 100 nm to about 5 μm. The size of magnetic particles can be chosen based on different applications or processes. In embodiments, the volume percentage of magnetic particles used for mixing may also vary depending on the different application or process for which the particles are being used. For example, from about 5% to about 80%, or from about 10% to about 50%, or from about 15% to about 25% magnetic particles may be added to the vessel.

The magnetic field may have a strength of from about 500 Gauss to about 50,000 Gauss, or from about 1000 Gauss to about 20,000 Gauss, or from about 2000 Gauss to about 15,000 Gauss. In embodiments, the electromagnets are circularly patterned with a uniform angular spacing. In embodiments, the electromagnets are used to apply the varying (switchable) magnetic field in a circular motion on a micro or nano scale. The magnetic field may also be applied in an up and down, or left and right, or triangular motion. In specific embodiments, the varying magnetic field is applied by moving a permanent magnet. In embodiments, the varying magnetic field is biased by another constant magnetic field. The flexible system setup is not limited by the geometry of mixing vessel 80.

The non-magnetic abrasive particles may comprise one or more of aluminum oxide, silicon carbide, cerium oxide, zirconium oxide, ferric oxide, bauxite, cubic zirconia and diamond powder, and the like and mixtures thereof. In embodiments, the abrasive particles may have a diameter of less than 1 μm. In other embodiments, the abrasive particles may have a diameter of from about 5 nm to about 50 μm, or from about 10 nm to about 10 μm. The size of non-magnetic abrasive particles can be chosen based on different applications or processes. The non-magnetic abrasive particles have a nanoindentation hardness value of at least 4.9, or from about 5 to about 50, or from about 7.5 to about 50 GPa. The non-magnetic abrasive particles may have any regular or irregular shape including spherical, cubic, hexagonal, rod-shaped, granular, elliptical, flake, and the like and mixtures thereof. In embodiments, the volume percentage of non-magnetic abrasive particles (based on the total dry volume of the milling media) used for milling may also vary depending on the different application or process for which the particles are being used. For example, from about 5% to about 95%, or from about 10% to about 80%, or from about 20% to about 70% non-magnetic abrasive particles may be added to the vessel.

In specific embodiments, a weight ratio of magnetic particles to non-magnetic abrasive particles may be in a range of from about 0.5:10 to about 10:0.5, or from about 1:10 to about 10:1, or from about 2:10 to about 10:2. In further embodiments, a volume ratio of the total milling media (magnetic particles and non-magnetic abrasive particles) to the material to be mixed may be in a range of from about 0.5:10 to about 10:0.5, or from about 1:10 to about 10:1, or from about 2:10 to about 10:2.

The present embodiments are able to drive chaotic or random motion of magnetic particles across the whole solution at a micro scale. This type of random motion generates turbulence and helps facilitate a high shear milling of the materials being mixed to achieve optimal particle size reduction. Every magnetic particle provides an independent milling zone, and together generate bulk mixing which achieves an accumulative effect. The milling is efficient and uniform across the entire milling zone because of the uniform magnetic field distribution. For example, in embodiments, the resulting particles sizes achieved by the actuated milling are from about 10 nm to about 500 nm, or from about 20 nm to about 400 nm. The particle sizes achieved are also very consistent and those having sizes that fall within these stated ranges are very close to 100%. If micro sized magnetic particles are used, due to the large surface contact area between micro magnetic particles and the solution, micro milling due to enhanced local diffusion significantly produces homogeneous and global milling. The present embodiments thus provide small particles on the nano to micro scale and uniform distribution. The present embodiments also provide for the potential of higher viscosity (for example, a viscosity of from about 0.1 cP to about 100,000 cP at 25° C.) milling if the exposed magnetic field is large.

Another advantage of the present method and system is the fact that it is free of mechanical components and thus maintenance, which significantly reduces the cost of the system. The present embodiments are also free of noise.

The present embodiments may be used in many different applications, including solids dispersions for example, preparing toners, inks, wax, pigment dispersions and the like. The present embodiments may be used for any application that requires the preparation of small-sized particles at either the micro or nano scale.

Pigment Dispersions

Pigment dispersions are often used in the preparation of EA toners or inks. Conventional milling methods used for preparing pigment dispersions suffer from many drawbacks. In addition, the use of conventional milling methods consume lengthy periods of time to prepare the pigment dispersions, often exceeding four hours.

The present embodiments provide for the use of magnetic actuating chaotic motion of magnetic particles to prepare pigment dispersions as provided by milling capabilities at nano or micro scale. These embodiments apply cyclic magnetic field to drive the chaotic motion of the magnetic particles to provide consistent nano or micro scale shearing throughout the entire vessel, thus providing uniform dispersion of materials within a very short time frame (e.g., minutes). The magnetic particles under the varying magnetic field are also impacting on the pigment particles through enhanced head to head collision.

Figure 3:
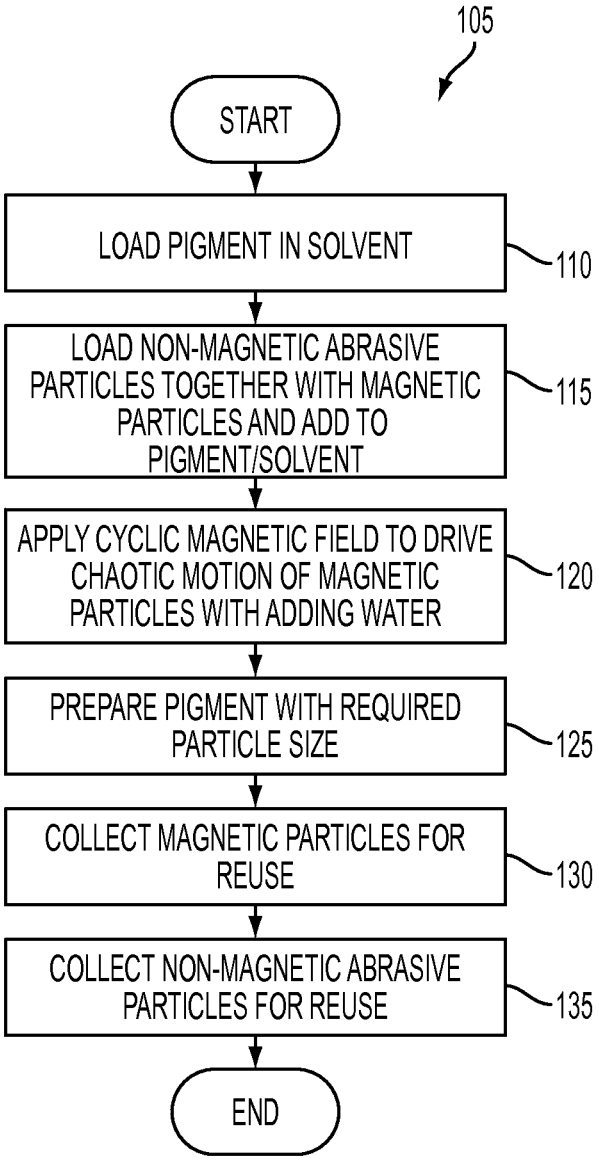
FIG. 3 is flow chart illustrating a method for preparing a latex emulsion or a pigment dispersion in accordance with the present embodiments.

In embodiments, there is provided a method for preparing pigment dispersions using magnetic actuated milling as shown in FIG. 3. A dry pigment is loaded in a solvent, such as water, an organic solvent or mixtures thereof, into the vessel 110. In embodiments, the pigment is selected from the group consisting of a blue pigment, a black pigment, a cyan pigment, a brown pigment, a green pigment, a white pigment, a violet pigment, a magenta pigment, a red pigment, an orange pigment, a yellow pigment, and mixtures thereof. In one embodiment, the pigment is carbon black. In embodiments, the pigment/water mixture comprises the pigment and water in a weight ratio of from about 5% to about 80%, or from about 10% to about 50%, or from about 15% to about 20%.

The vessel may have the magnetic particles and non-magnetic abrasives already pre-loaded in the vessel or the magnetic particles and non-magnetic abrasives may be loaded into the vessel after the pigment/solvent mixture 115. A surfactant may then be added to the pigment/solvent mixture in the vessel. In embodiments, the surfactant can be water-soluble polymers and surfactants. In embodiments, the surfactant is added in an amount of from 1% to about 30%, or from about 3% to about 15%, or from about 5% to about 12% by weight of the total weight of the mixture in the vessel. A magnetic field is generated and applied to the mixture and magnetic particles in the vessel 120. A pigment dispersion with the desired particle size is then achieved by continued chaotic motions of the magnetic particles through application of the magnetic field. A reduction in pigment particles 125 is achieved. The duration and speed of milling will be dependent on the pigment particle size desired. The magnetic particles and and non-magnetic abrasives abrasive particles can then be collected for re-use 130 and 135.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter. The embodiments will be described in further detail with reference to the following examples and comparative examples. All the "parts" and "%" used herein mean parts by weight and % by weight unless otherwise specified.

Comparative Example 1

Magnetic milling was conducted with only magnetic particles (5 micron carbonyl Iron). Into a 9 ml glass vial was added 0.85 g of carbon black pigment powder Regal 330, 1.37 g of DIW, 0.45 g (18.75 wt %) tayca power and 2.62 ml of 5 micron carbonyl iron. The vial was then spinned using an agitator at 400 rpm beside a permanent magnet having magnetic field about 400 mT. The particle size of pigment was then measured after 30 min.

Comparative Examples 2-4

Comparative Example 1 was repeated, except that 35 micron iron oxide, 250 micron and 800 micron steel shots was used as magnetic particles, respectively, instead of 5 micron carbonyl iron.

Figure 4:
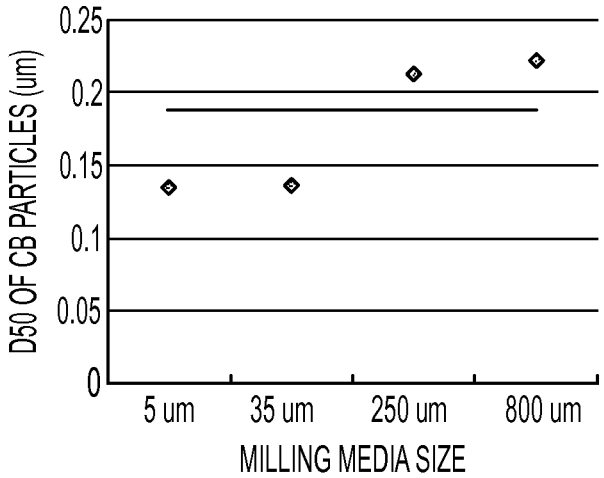
FIG. 4 is a graph illustrating the impact of milling media size on the resulting pigment particle size.

The pigment particle size of Comparative Examples 1 to 4 was measured and plotted in FIG. 4. The black line indicates particle size before milling. It shows that pigment particle size is reduced only when using 5 um or 35 um magnetic particles. Therefore, Example 1 to 6 below only used 5 and 35 micron magnetic particles.

Example 1

Magnetic milling was conducted with 5 micron magnetic particles and nonmagnetic abrasives in the following manner: into a 9 ml vial was added 0.85 g of carbon black pigment powder Regal 330, 1.37 g of de-ionized water (DIW), 0.45 g (18.75 wt %) tayca power and 2.62 ml of 5 micron carbonyl iron and nonmagnetic abrasives $Al_2O_3$ (<10 microns) at an abrasive concentration of 0.33. The abrasive concentrations were calculated as follows:

$$\text{Abrasive concentration} = \frac{\text{Abrasive Dry Volume}}{\text{Total Dry Volume of Milling Media}}$$

The vial was then spinned using an agitator at 400 rpm beside a permanent magnet having magnetic field about 400 mT. The particle size of pigment was then measured after 30 min.

Example 2

Magnetic milling was conducted in the same manner as Example 1 except that the abrasive concentration used was 0.50.

Example 3

Magnetic milling was conducted in the same manner as Example 1 except that the abrasive concentration used was 0.75.

Example 4

Magnetic milling was conducted with 35 microns magnetic particles and nonmagnetic abrasives in the following manner: into a 9 ml vial was added 0.85 g of carbon black pigment powder Regal 330, 1.37 g of DIW, 0.45 g (18.75 wt %) Tayca power and 2.62 ml of 35 microns iron oxide and nonmagnetic abrasives $Al_2O_3$ (<10micron) at an abrasive concentration of 0.33.

The vial was then spun using an agitator at 400 rpm beside a permanent magnet having magnetic field about 400 mT. The particle size of pigment was then measured after 30 min.

Example 5

Magnetic milling was conducted in the same manner as Example 4 except that the abrasive concentration used was 0.50.

Example 6

Magnetic milling was conducted in the same manner as Example 4 except that the abrasive concentration used was 0.75.

Examples 7-12

Experiments for Examples 1-6 were repeated, except that 16 micron SiC abrasives were used instead of $Al_2O_3$ (<10 microns).

TEST RESULTS

Figure 5:
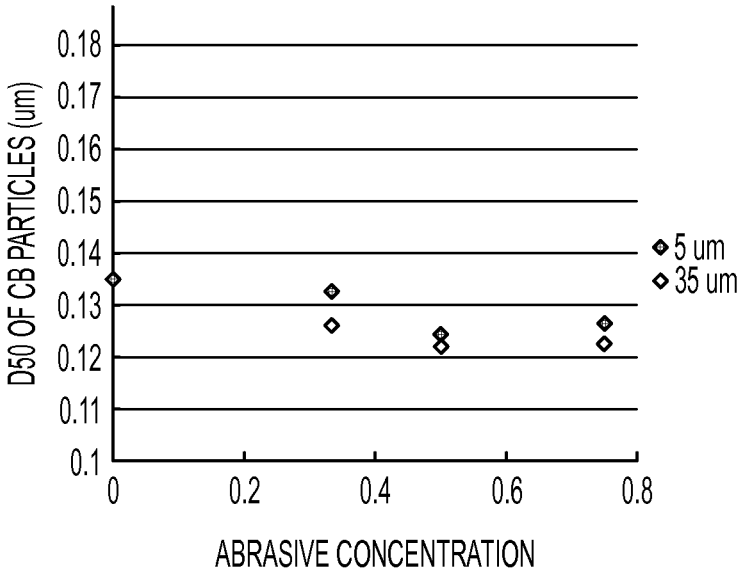
FIG. 5 is a graph illustrating the impact of non-magnetic abrasive particles according to one embodiment on the resulting pigment particle size.

The pigment particle size of Examples 1-6 was measured and plotted in FIG. 5. As comparison, results of comparative Examples 1 and 2 are also shown as abrasive concentration=0, and they are on top of each other. FIG. 5 shows that when using $Al_2O_3$ (<10 microns) as abrasive, abrasive concentration of 0.5 resulted in the most particle size reduction.

Figure 6:
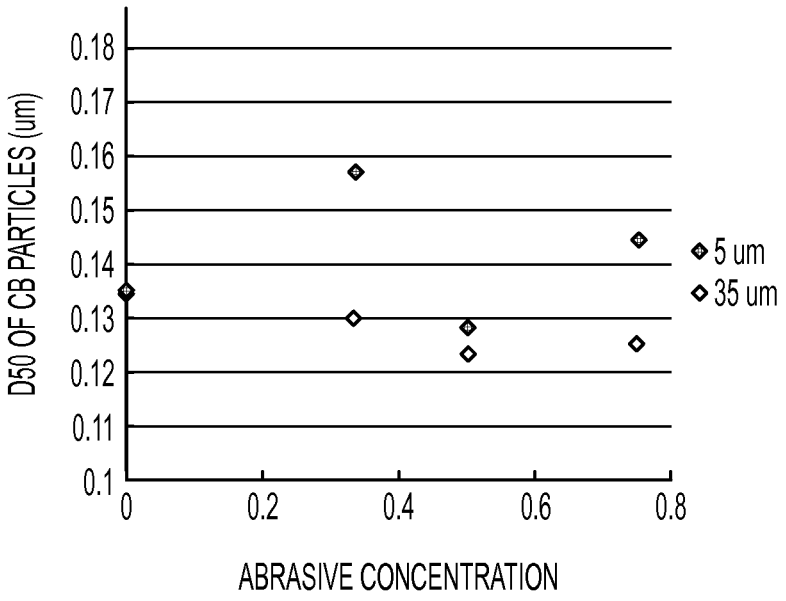
FIG. 6 is a graph illustrating the impact of non-magnetic abrasive particles according to another embodiment on the resulting pigment particle size.

The pigment particle size of Examples 7-12 was measured and plotted in FIG. 6. FIG. 6 shows that combination of 35 micron magnetic particles with 16 micron SiC is more effective at reducing particle size than combination of 5 micron Carbonyl iron with SiC. And in comparing with comparative Example 1, there was no further particle size reduction when combining 5 micron carbonyl iron with 16 micron SiC abrasives.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for milling one or more materials on a nano or micro scale, comprising:

a) adding one or more materials into a vessel;
b) adding magnetic particles into the vessel;
c) adding non-magnetic abrasive particles into the vessel;
d) applying a varying magnetic field to the magnetic particles to move the magnetic particles;
e) milling the one or more materials in the vessel with the magnetic and non-magnetic abrasive particles until a desired particle size is achieved;
f) collecting the magnetic particles for re-using at a later time; and
g) collecting the non-magnetic abrasive particles for re-using at a later time.

2. The method of claim 1, wherein the one or more materials includes materials used to make a toner, ink, wax, paint or photoreceptor material.

3. The method of claim 1, wherein the magnetic particles are comprised of a, paramagnetic, ferromagnetic, ferrimagnetic or antiferromagnetic material.

4. The method of claim 1, wherein the non-magnetic abrasive particles have a particle diameter size of from about 5 nm to about 50 μm.

5. The method of claim 1, wherein the non-magnetic abrasive particles are selected from the group consisting of aluminum oxide, SiC, cerium oxide, zirconium oxide, ferric oxide, bauxite, cubic zirconia powder, diamond powder, and mixtures thereof.

6. The method of claim 1, wherein the non-magnetic abrasive particles have a nanoindentation hardness value of at least 4.9 GPa.

7. The method of claim 1, wherein a weight ratio of magnetic particles to non-magnetic abrasive particles in the vessel is in a range of from about 0.5:10 to about 10:0.5.

8. The method of claim 1, wherein a volume ratio of the magnetic particles and non-magnetic abrasive particles to the one or more materials is in a range of from about 0.5:10 to about 10:0.5.

9. The method of claim 1, wherein the magnetic field has a strength of from about 500 Gauss to about 50,000 Gauss.

10. The method of claim 1, wherein the magnetic field is applied through one or more electromagnets.

11. The method of claim 10, wherein the one or more electromagnets are circularly patterned with a uniform angular spacing.

12. The method of claim 1, wherein the magnetic field is applied to drive magnetic particles in a circular, up and down, left and right, or triangular motion.

13. The method of claim 1, wherein the varying magnetic field is biased by another constant magnetic field.

14. The method of claim 1, wherein the varying magnetic field is applied by moving a permanent magnet.

15. A method for milling one or more materials on a nano or micro scale, comprising:

a) pre-loading magnetic particles and non-magnetic abrasive particles into a vessel;

b) adding one or more materials into the vessel;

c) applying a varying magnetic field to the magnetic particles to move the magnetic particles;

d) milling the one or more materials in the vessel with the magnetic and non-magnetic abrasive particles until a desired particle size is achieved;

e) collecting the magnetic particles for re-using at a later time; and f) collecting the non-magnetic abrasive particles for re-using at a later time.

16. The method of claim 15, wherein collecting the magnetic particles is performed with an electromagnet.

17. The method of claim 15, wherein collecting the non-magnetic abrasive particles is performed with a filter or centrifuge.

18. A system for milling one or more materials on a nano or micro scale, comprising:

a) a vessel for holding one or more materials;

b) magnetic particles for milling the one or more materials;

c) non-magnetic abrasive particles for milling the one or more materials;

d) a source for applying a periodically varying magnetic field to the magnetic particles to move the magnetic particles;

e) a first collector for collecting the magnetic particles for re-using at a later time; and f) a second collector for collecting the non-magnetic abrasive particles for re-using at a later time.

19. The system of claim 16, wherein the magnetic particles are comprised of a diamagnetic, paramagnetic, ferromagnetic, ferromagnetic or antiferromagnetic material.

20. The system of claim 16, wherein the one or more materials comprises pigment particles, a surfactant and a solvent.

* * * * *